US009194396B2

(12) United States Patent
Chiang

(10) Patent No.: US 9,194,396 B2
(45) Date of Patent: Nov. 24, 2015

(54) FAN MODULE

(71) Applicants: Inventec (Pudong) Technology Corporation, Shanghai (CN); INVENTEC CORPORATION, Taipei (TW)

(72) Inventor: Meng-Lung Chiang, Taipei (TW)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 428 days.

(21) Appl. No.: 13/784,577

(22) Filed: Mar. 4, 2013

(65) Prior Publication Data

US 2014/0119909 A1 May 1, 2014

(30) Foreign Application Priority Data

Oct. 31, 2012 (CN) ..... 2012 1 0428282

(51) Int. Cl.

| | |
|---|---|
| ***F04D 17/00*** | (2006.01) |
| ***F04D 17/10*** | (2006.01) |
| ***F04D 25/06*** | (2006.01) |
| *F04D 27/00* | (2006.01) |
| *F04D 29/42* | (2006.01) |

(52) U.S. Cl.

CPC ..... *F04D 17/105* (2013.01); *F04D 25/0613* (2013.01); *F04D 27/002* (2013.01); *F04D 29/424* (2013.01)

(58) Field of Classification Search

CPC ... F04D 29/287; F04D 29/42; F04D 29/4213; F04D 29/4226; F04D 29/4233; F04D 29/4246

See application file for complete search history.

(56) References Cited

U.S. PATENT DOCUMENTS

| | | | | |
|---|---|---|---|---|
| 2,001,522 | A * | 5/1935 | Chester | 415/148 |
| 6,074,181 | A * | 6/2000 | James | 417/366 |
| 8,684,676 | B1 * | 4/2014 | Kirkpatrick | 415/151 |
| 2007/0227142 | A1 * | 10/2007 | Blaylock et al. | 60/600 |
| 2008/0267764 | A1 * | 10/2008 | Tsai et al. | 415/53.3 |
| 2009/0193806 | A1 * | 8/2009 | Kong et al. | 60/602 |
| 2014/0356138 | A1 * | 12/2014 | Sun et al. | 415/148 |

* cited by examiner

*Primary Examiner* — Nathan J Newhouse
*Assistant Examiner* — Christopher Bobish
(74) *Attorney, Agent, or Firm* — Locke Lord LLP; Tim Tingkang Xia, Esq.

(57) ABSTRACT

A fan module, disposed inside a case of an electronic device, includes a case body, a blade assembly, a stopping plate and an adjusting element. The case body, including a first case unit, a sidewall and a second case unit, forms an accommodating space. The first case unit or/and the second case unit has an air inlet. The sidewall has an air outlet and an adjusting opening. The blade assembly is disposed inside the accommodating space. The stopping plate, disposed on the sidewall, is for opening or closing the adjusting opening. The adjusting element is movably disposed on the stopping plate and for pressing against the stopping plate. When the adjusting element moves from a first position toward a second position, the adjusting element pushes against and makes the stopping plate to be offset toward the blade assembly, and produces a gap between the stopping plate and the sidewall.

8 Claims, 7 Drawing Sheets

FAN MODULE

CROSS-REFERENCE TO RELATED APPLICATIONS

This non-provisional application claims priority under 35 U.S.C. §119(a) on Patent Application No(s). 201210428282.6 filed in China on Oct. 31, 2012, the entire contents of which are hereby incorporated by reference.

BACKGROUND

1. Technical Field

The disclosure relates to a fan module, and more particularly to a fan module with an adjustable air inlet.

2. Related Art

As the function of electronic products keeps enhancing, the thermal power of electronic components keeps enhancing accordingly. The computing speed of electronic products will reduce or even causes malfunctions if the heat of electronic components cannot be dissipated effectively. Therefore, heat dissipation is becoming more emphasized by people. Furthermore, heat dissipation is especially important for compact electronic products, such as laptops, hand-held computers and communication devices, etc.

Take the heat dissipation for a laptop as an example; a heat dissipation module is usually employed in the industry for dissipating the heat of various electronic components directly. Conventionally, the heat dissipation module in a laptop comprises a fan module, a heat pipe and a fin assembly. An end of the heat pipe is in thermal contact with the electronic components, and another end of the heat pipe is in thermal contact with the fin assembly. The heat produced by the electronic components is transferred by the heat pipe to the fin assembly of the heat dissipation module. Then, the operation of the fan module draws the hot air inside the electronic components and produces an air current to exchange heat with the fin assembly. Afterwards, the heat energy is discharged outside the electronic product. Thereby, the heat dissipation for the heating electronic components is achieved.

Generally, the fan module used inside a laptop is a centrifugal fan module for being disposed inside the laptop. The fan module mainly comprises a fan, an upper cover, a side cover and a lower cover. The fan is disposed between the upper cover and lower cover. The upper cover and the lower cover face an upper case and a lower case of the laptop respectively. The upper cover has an air inlet as well as the side cover between the upper cover and the lower cover has an air outlet. When the fan operates and produces an air current, the fan draws the hot air inside the laptop from the air inlet of the upper cover into the fan module. Then, the air current inside the fan is discharged from the air outlet. Thereby, the above mentioned operation can eliminate the hot air and the heat produced by the electronic components inside the laptop.

However, electronic products nowadays are designed to feature the characteristics of being compact, slim and light. In order to achieve the objectives of being compact, slim and light, a distance between the upper case and the lower case of a laptop has to be reduced. Therefore, the upper case and the lower case inside the laptop are respectively disposed proximate to the upper cover and the lower cover of the fan module. The upper case and the lower case will block an air current passage to the air inlet. When the air current passage is blocked, the amount of air current entering into the fan module is reduced substantially and the heat dissipation efficiency of the fan module is also reduced. When the heat dissipation efficiency of the fan module is reduced, the heat produced by the electronic components inside the laptop cannot be discharged effectively. This increases the temperatures of the electronic components and possibly reduces the computing speed of the laptop or even causes malfunction. Furthermore, fan modules with different designs are required for fitting different laptops when a distance between the upper case and the lower case of a laptop is different. This manufacturing mode for fitting different laptop models will increase the manufacturing cost of fan module substantially.

SUMMARY

According to an embodiment of the disclosure, a fan module, for being disposed inside a case of an electronic device, comprises a case body, a blade assembly, a stopping plate and an adjusting element. The case body comprises a first case unit, a sidewall and a second case unit. The sidewall is connected between the first case unit and the second case unit to form an accommodating space together. At least one of the first case unit or the second case unit has an air inlet. The sidewall has an air outlet and an adjusting opening. The blade assembly is disposed inside the accommodating space. The stopping plate is disposed on the sidewall and is used for opening or closing the adjusting opening. The adjusting element is movably disposed on a side of the stopping plate and is used for pressing against the stopping plate. The adjusting element is used for moving between a first position and a second position. When the adjusting element moves from the first position toward the second position, the adjusting element pushes against the stopping plate and makes an end of the stopping plate to be offset toward the blade assembly, and produces a gap between the stopping plate and the sidewall.

A fan module disclosed in an embodiment of the present disclosure is used for disposing inside a case of an electronic device. The fan module comprises a case body, a blade assembly, a stopping plate and an adjusting element. The case body comprises a first case unit, a sidewall and a second case unit. The sidewall is connected between the first case unit and the second case unit in order to form an accommodating space together. At least the first case unit or the second case unit has an air inlet. The sidewall has an air outlet and an adjusting opening. The blade assembly is disposed inside the accommodating space. The stopping plate is disposed on the sidewall and is used for opening or closing the adjusting opening. The adjusting element is movably disposed on a side of the stopping plate and is used for pressing against the stopping plate. The adjusting element moves between a first position and a second position. When the adjusting element moves from the first position toward the second position, the adjusting element pushes against the stopping plate and makes an end of the stopping plate to offset toward the blade assembly. Thereby, a gap is produced between the stopping plate and the sidewall.

BRIEF DESCRIPTION OF THE DRAWINGS

The disclosure will become more fully understood from the detailed description given herein below for illustration only, and thus is not limitative of the disclosure, and wherein.

DETAILED DESCRIPTION

The detailed characteristics and advantages of the disclosure are described in the following embodiments in details, the techniques of the disclosure can be easily understood and embodied by a person skilled in the art, and the related objects and advantages of the disclosure can be easily understood by a person skilled in the art by referring to the contents, the claims and the accompanying drawings disclosed in the specifications. The embodiments below are further used for explaining the disclosure rather than limiting the scope of the disclosure.

A fan module provided by the disclosure is disposed inside a case of an electronic device and used for eliminating hot air heated by the electronic device. In this embodiment, the fan module is a centrifugal fan module and the electronic device is a laptop, but they should not be construed as limitations to the disclosure. In other embodiments, the electronic device is a personal digital assistant (PDA), a tablet computer, a home gaming console or a computing device with compact and slim design.

Figure 1:
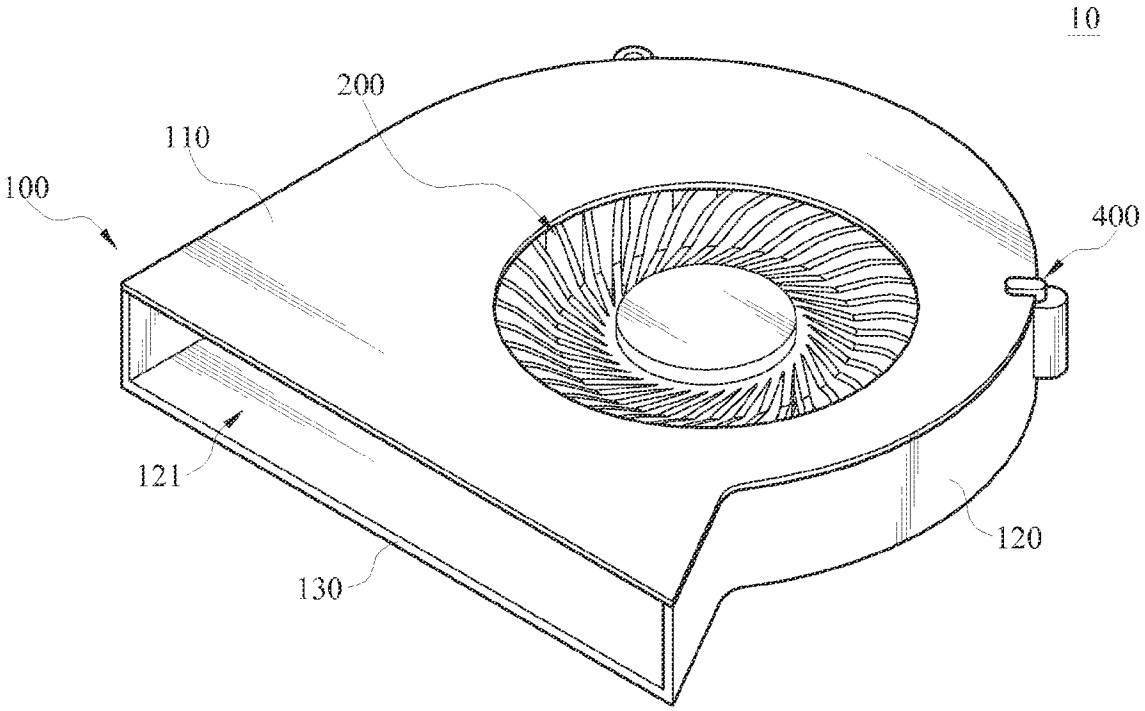
FIG. 1 is a perspective view of a fan module according to an embodiment of the disclosure.
Figure 2:
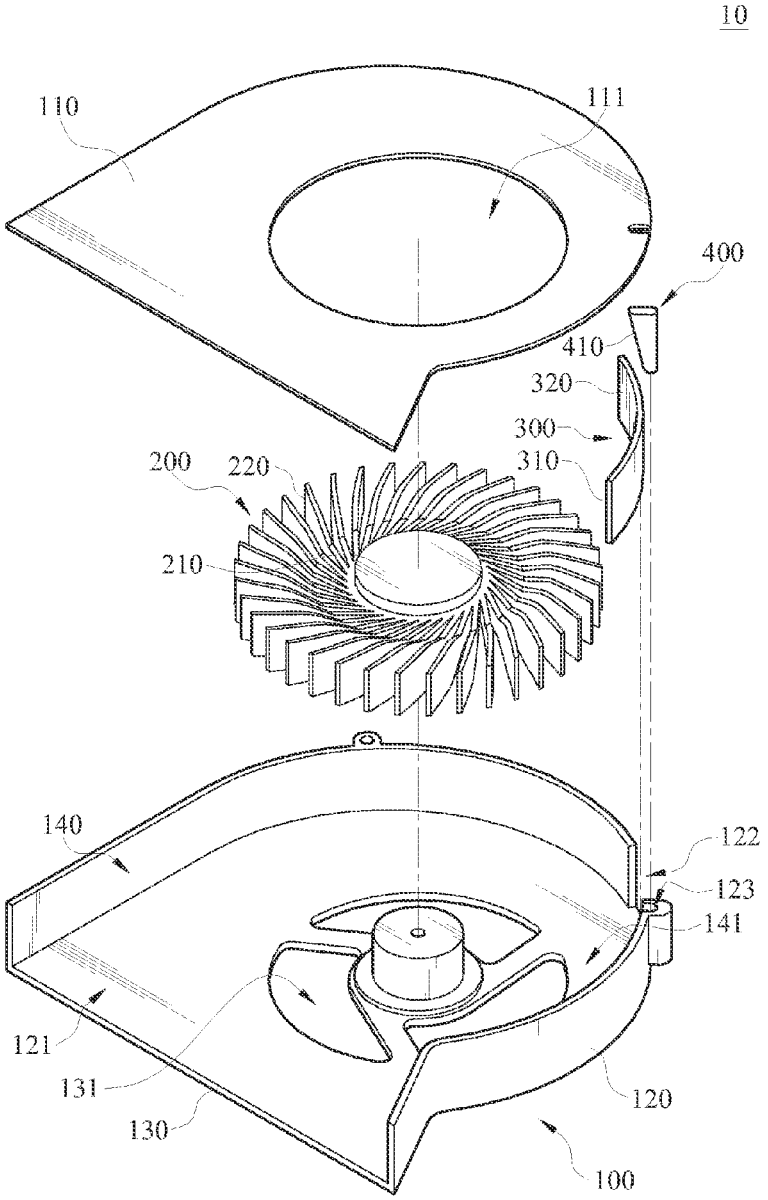
FIG. 2 is a perspective exploded view of the fan module according to an embodiment of the disclosure.
Figure 3:
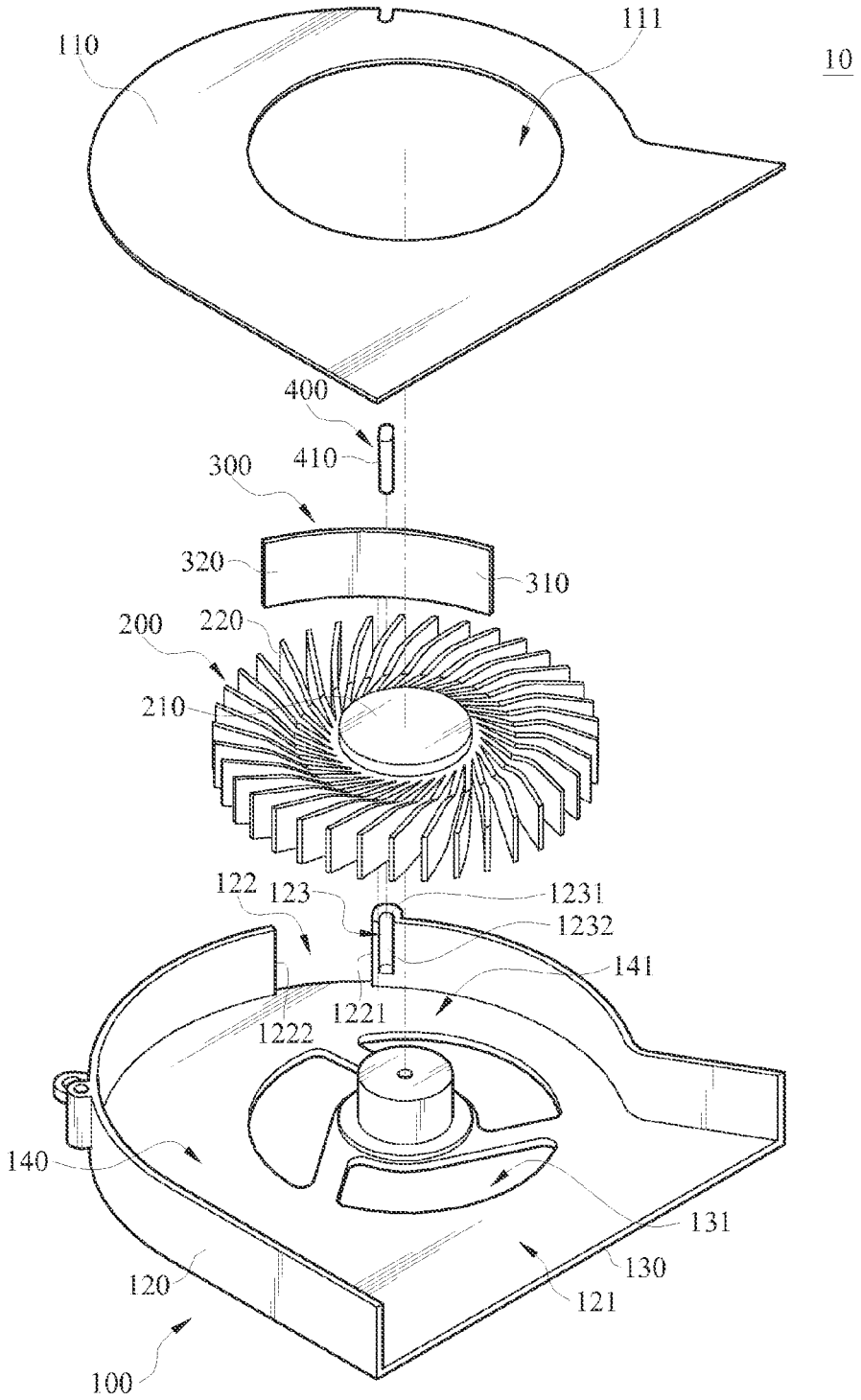
FIG. 3 is a perspective exploded view of the fan module being viewed from another angle according to an embodiment of the present disclosure.

Please refer to FIGS. 1 to 3. FIG. 1 is a perspective view of a fan module according to an embodiment of the disclosure; FIG. 2 is a perspective exploded view of the fan module according to an embodiment of the disclosure; and FIG. 3 is a perspective exploded view of the fan module being viewed from another angle according to an embodiment of the disclosure.

Figure 4:
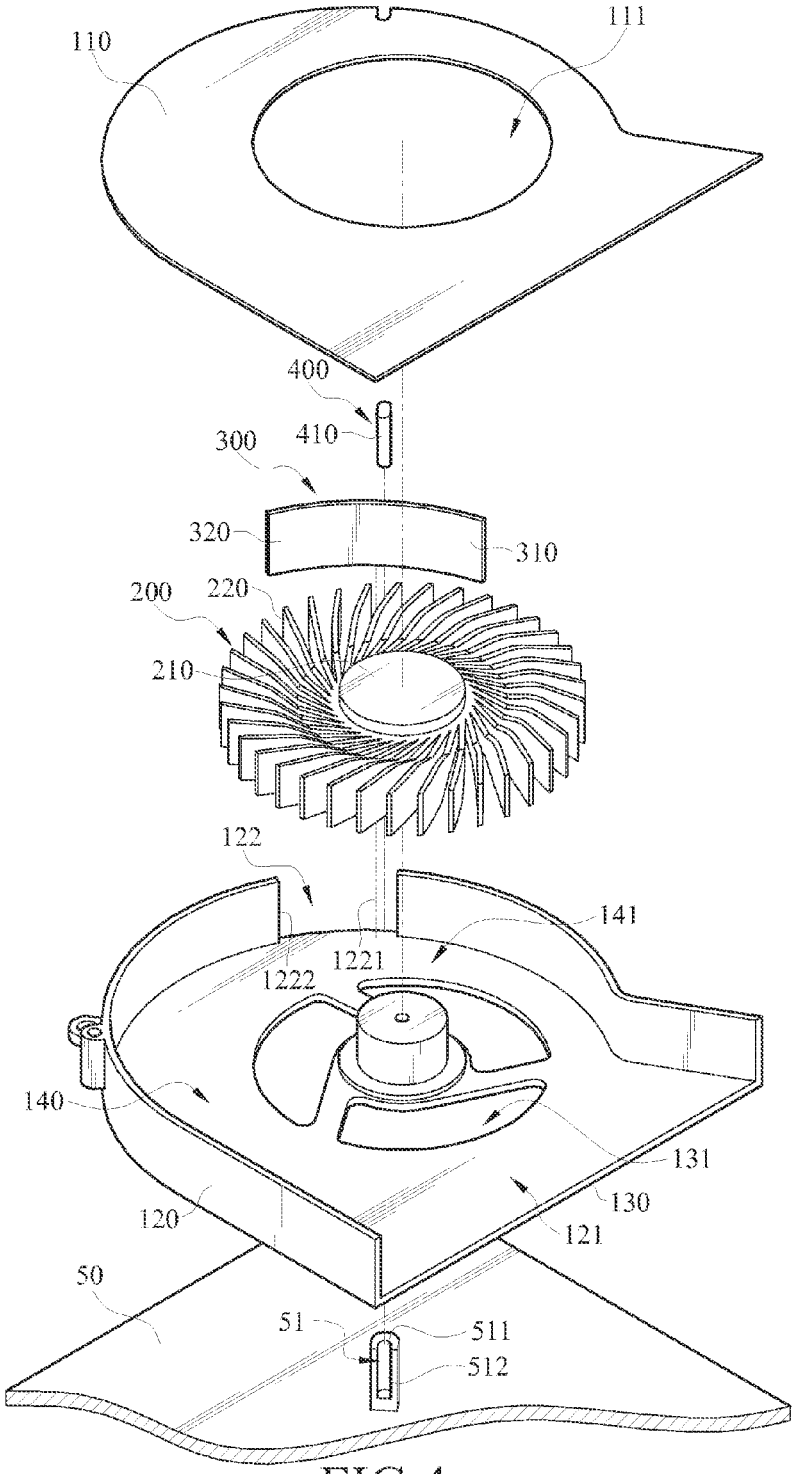
FIG. 4 is a perspective exploded view of the fan module according to another embodiment of the disclosure.

A fan module 10 of this embodiment comprises a case body 100, a blade assembly 200, a stopping plate 300 and an adjusting element 400. The case body 100 is used for protecting the elements inside the fan module 10 in order to prevent the elements inside the fan module 10 from being exposed to outside conditions. The case body 100 comprises a first case unit 110, a sidewall 120 and a second case unit 130. The first case unit 110 and the second case unit 130 are disposed oppositely to each other and kept away from each other at a distance. The first case unit 110 has an air inlet 111 and the air inlet 111 passes through the first case unit 110. In this embodiment and some of other embodiments, the second case unit 130 can also have another air inlet 131 and the air inlet 131 passes through the second case unit 130. The sidewall 120 is connected between the first case unit 110 and the second unit 130 in order so an accommodating space 140 is formed by the first case unit 110, the second case unit 130 and the sidewall 120 together. The sidewall 120 has an air outlet 121 and an adjusting opening 122. The air outlet 121 is disposed at a side of the sidewall 120. In this embodiment and some of other embodiments, the adjusting opening 122 has a first end 1221 and a second end 1222 disposed oppositely to each other. In this embodiment and some other embodiments, the sidewall 120 further comprises a socket 123. The socket 123 extends from the first case unit 110 toward the second case unit 130. The socket 123 has a hole 1231 and an opening 1232. The hole 1231 faces the outside of the case body 100 and the opening 1232 faces the accommodating space 140. However, the disposing position of the socket 123 should not be construed as a limitation to the disclosure. Please refer to FIG. 4. FIG. 4 is a perspective exploded view of the fan module according to another embodiment of the disclosure. In other embodiments, the fan module 10 is disposed on a case 50 of an electron device. The case 50 comprises a socket 51. The socket 51 has a hole 511 and an opening 512. The hole 511 faces the outside of the case body 100 and the opening 512 faces the accommodating space 140.

Please refer to FIGS. 1 to 3 again. In this embodiment, the blade assembly 200 is disposed inside the accommodating space 140. More specifically, the blade assembly 200 has a set of blades 220 and a shaft 210. The blades 220 are disposed around the shaft 210. The blade assembly 200 is designed centrifugally and therefore an axis of the shaft 210 is not disposed at the center of the case body 100. In other words, a distance between a circumference of the blade assembly 200 and the sidewall 120 is not a fixed value. In this embodiment and some of other embodiments, a compressing area 141 is defined inside the accommodating space 140 and a distance between the sidewall 120 and the blade assembly 200 at the compressing area 141 is relatively shorter than the distance. between the sidewall 120 and the blade assembly 200 outside the compressing area 141. Therefore, when the fan module 10 operates, a flow speed of an air current inside the compressing area 141 is relatively faster which causes the air current pressure to be smaller than the atmospheric pressure outside the case body 100. The adjusting opening 122 is disposed at the compressing area 141. Therefore, when the fan module 10 operates, the blade assembly 200 can draw an external air current through the adjusting opening 122.

The stopping plate 300 is disposed on the sidewall 120 and is used for opening or closing the adjusting opening 122. More specifically, the stopping plate 300 has a fixed end 310 and a free end 320. The fixed end 310 and the free end 320 are disposed oppositely to each other. The fixed end 310 is fixed on the sidewall 120 and is adjacent to the first end 1221 of the adjusting opening 122. The fixed end 310 can be fixed on the sidewall 120 by adhering or locking. But the means for fixing the fixed end 310 should not be construed as a limitation to the disclosure. In other embodiments, the fixed end 310 can be affixed to the sidewall 120 by employing other means. Furthermore, in this embodiment, the free end 320 extends from the fixed end 310 to the second end 1222. The free end 320 can be moved in relative to the sidewall 120 by an external force. Furthermore, the stopping plate 300 is disposed between the adjusting opening 122 and the blade assembly 200. But the disposing position of the stopping plate 300 should not be construed as a limitation to the disclosure. In other embodiments (not shown in the drawings), the stopping plate 300 can be disposed outside the case body 100. That means the stopping plate 300 is disposed between the adjusting opening 122 and an external space, and the fixed end 310 can be affixed to the outer side of the sidewall 120. The effects of the disclosure can also be achieved. Therefore, by employing the structure of the movable stopping plate 300, a size of a sectional area of an air current passage, which an external air enters into the accommodating space 140 through the adjusting opening 122, can be adjusted.

Figure 6:
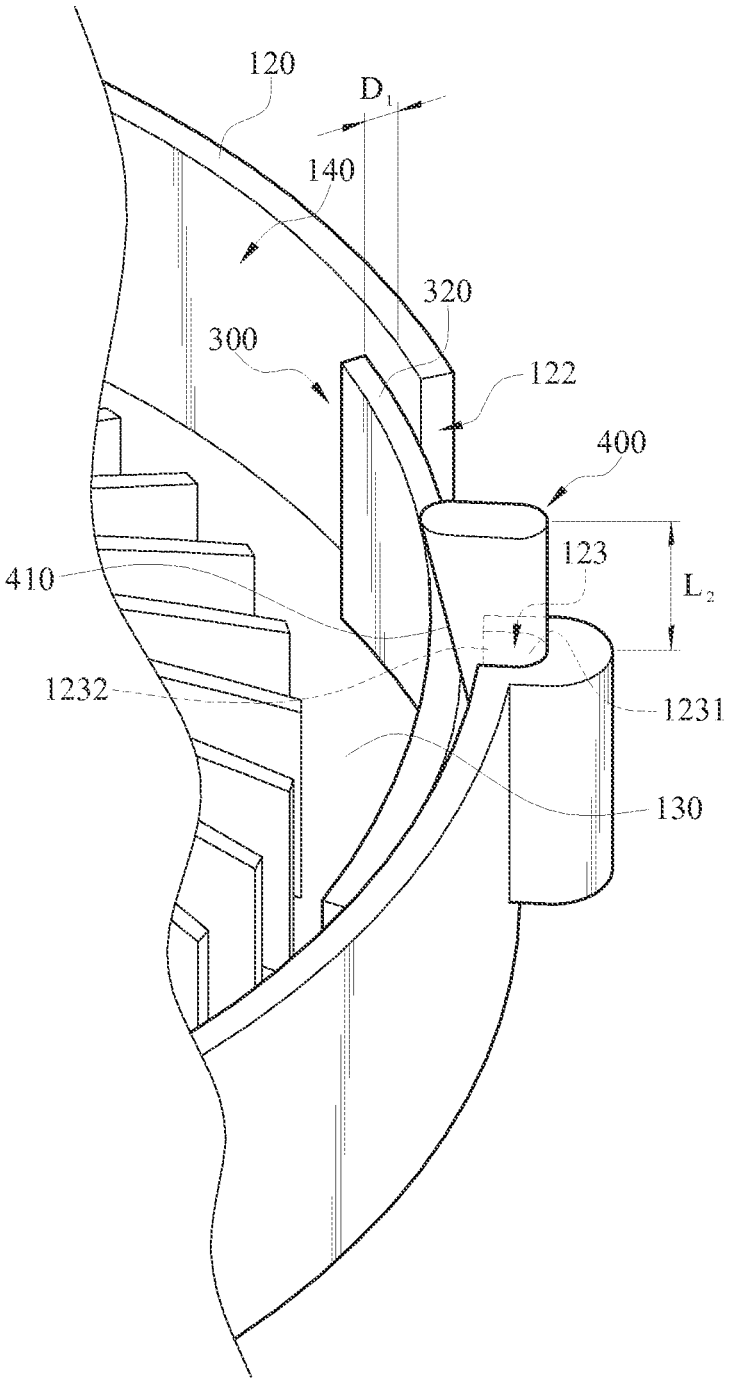
FIG. 6 is a second perspective operational view of the adjusting element and the stopping plate of the fan module according to an embodiment of the disclosure.

In this embodiment, the adjusting element 400 is movably disposed on a side of the stopping plate 300 and is used for pressing against the stopping plate 300. In other words, in this embodiment, the adjusting element 400 is inserted into the socket 123 from the hole 1231 in a movable manner such that the adjusting element 400 is pressed against the stopping plate 300 next to the socket 123. Please refer to FIGS. 2, 3 and 6. FIG. 6 is a second perspective operational view of the adjusting element 400 and the stopping plate 300 of the fan module 10 according to the embodiment of the disclosure. More specifically, the adjusting element 400 is a tapered object and an outer diameter of the adjusting element 400 is decreased toward a direction of the adjusting element when inserting into the socket 123. The adjusting element 400 has an inclined pressing side 410 for pressing against an edge of the stopping plate 300. Furthermore, when the adjusting element 400 is disposed inside the socket 123, a part of the adjusting element 400 is protruded outside the opening 1232 of the socket 123, and the inclined pressing side 410 of the adjusting element 400 is pressed against the stopping plate 300. Another part of the adjusting element 400 can be engaged inside the socket 123. But the shape of the adjusting element 400 should not be construed as a limitation to the disclosure. In other embodiments, the adjusting element 400 is be a pin, a cam, a screw or a gear, and the effects of the disclosure can also be achieved.

Figure 5:
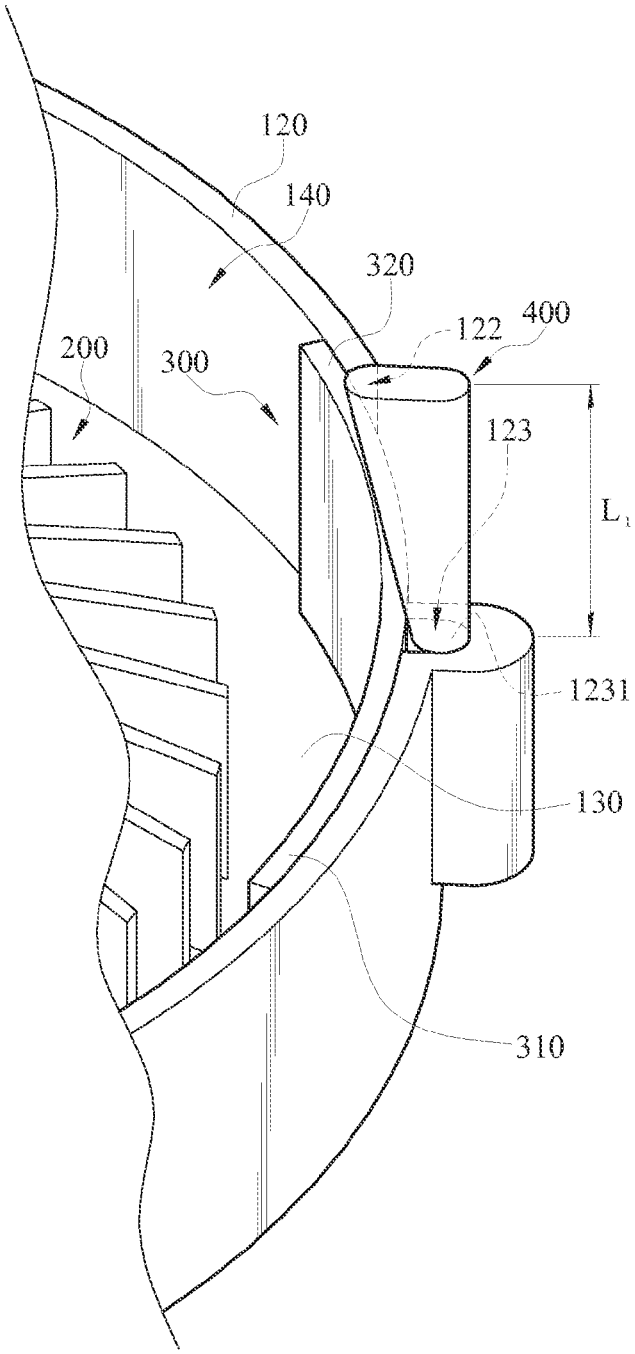
FIG. 5 is a first perspective operational view of an adjusting element and a stopping plate of the fan module according to an embodiment of the disclosure.

The way of how the adjusting element 400 adjusts a size of the adjusting opening 122 will be described hereinafter. Relative to the socket 123, the adjusting element 400 has a first position, a second position and a third position. Firstly, please refer to FIG. 5. FIG. 5 is a first perspective operational view of the adjusting element 400 and the stopping plate 300 of the fan module 10 according to the embodiment of the disclosure. As shown in the drawing, when the adjusting element 400 is at the first position, the adjusting element 400 faces the hole 1231 and the adjusting element 400 is not yet inserted into the socket 123 and not yet in contact with the stopping plate 300. At the same time, the stopping plate 300 covers the adjusting opening 122. A length of the adjusting element 400 exposed outside the socket 123 is a first length L1.

Then, please refer to FIG. 6. As shown in the drawing, the adjusting element 400 moves from the first position along a direction of the adjusting element 400 inserting into the socket 123 reaching the second position. The adjusting element 400 is gradually inserted into the socket 123 pressing against the stopping plate 300 to cause the free end 320 of the stopping plate 300 to move toward the blade assembly 200. And a gap (a first gap D1 shown in the drawing) is produced between the free end 320 of the stopping plate 300 and the sidewall 120. In other words, the adjusting element 400 enters into the socket 123 through the hole 1231 and a part of the adjusting element 400 enters the accommodating space 140 towards the blade assembly 200 from the opening 1232. Thereby, the stopping plate 300 is being pressed by the adjusting element 400. Because the fixed end 310 of the stopping plate 300 is already fixed on the sidewall 120, the free end 320 of the stopping plate 300 is pressed against by the adjusting element 400 and moved toward the blade assembly 200. A gap between the free end 320 and the sidewall 120 is enlarged comparing with the gap at the first position, and therefore an external air current can enter into the accommodating space 140 from the adjusting opening 122. Furthermore, a length of the adjusting element 400 exposed outside the socket 123 is a second length L2. The first length L1 in FIG. 5 is longer than the second length L2 in FIG. 6. This shows that the adjusting element 400 can move between the first position and the second position inside the socket 123.

Figure 7:
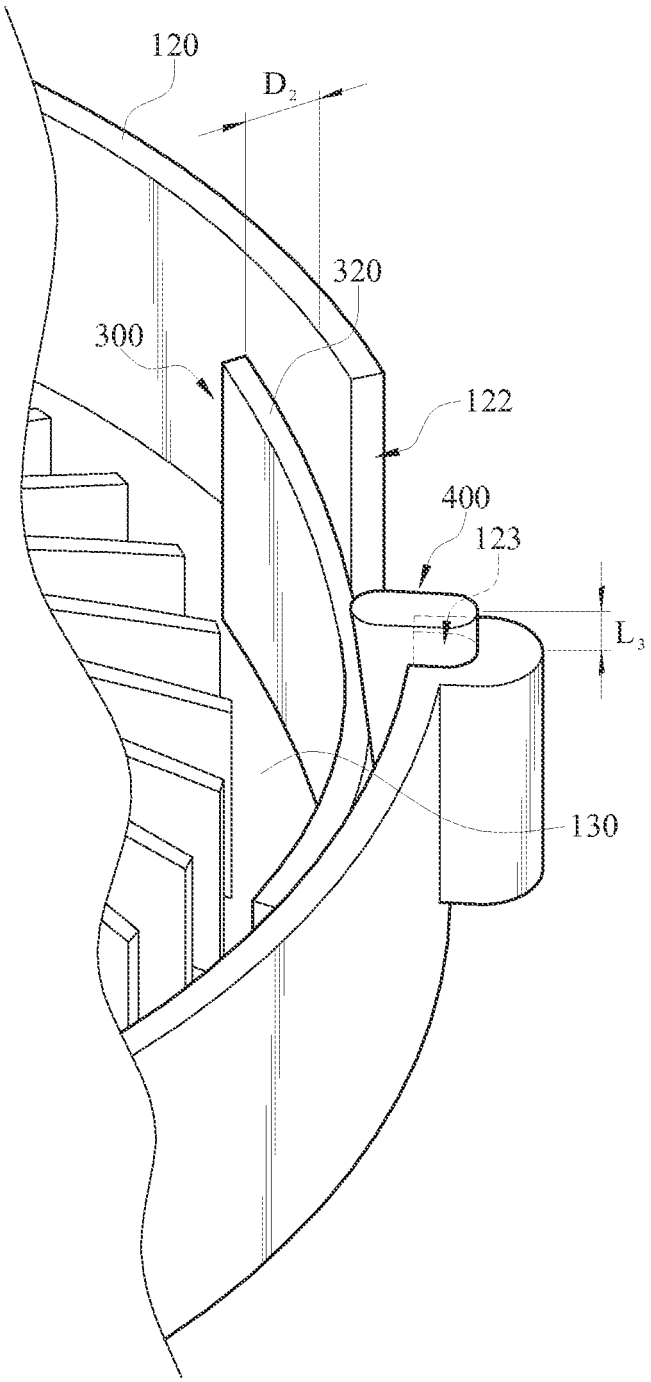
FIG. 7 is a third perspective operational view of the adjusting element and the stopping plate of the fan module according to an embodiment of the disclosure.

Please refer to FIG. 7, which is a third perspective operational view of the adjusting element 400 and the stopping plate 300 of the fan module 10 according to the embodiment of the disclosure. As shown in the drawing, the adjusting element 400 continues to move from the second position toward a direction of inserting into the socket 123 reaching the third position. Because the outer diameter of the adjusting element 400 is decreased toward a direction of inserting into the socket 123, a part of the adjusting element 400 continues to press against the stopping plate 300 and causes the free end 320 of the stopping plate 300 to still move toward the blade assembly 200. Thereby, a gap (a second gap D2 shown in the drawing) between the free end 320 and the sidewall 120 is further increased. Comparing with the first gap D1 in FIG. 6, the second gap D2 in FIG. 7 is longer than the first gap D1 in order to increase an amount of external air current entering into the case body 100 from the adjusting opening 122. Additionally, a length of the adjusting element 400 exposed outside the socket 123 is a third length L3. The second length L2 in FIG. 6 is longer than the third length L3 in FIG. 7.

Please refer to FIGS. 1 to 3. The fan module 10 disclosed by the disclosure can be disposed inside an electronic device (not shown in the drawings). The air inlets 111 and 131 of the fan module 10 face toward an upper case (not shown in the drawings) and a lower case (not shown in the drawings) respectively. The air outlet 121 of the fan module 10 is exposed outside of the electronic device. When the fan module 10 operates to drive the blade assembly 200 to rotate, an external air current enters into the case body 100 from the air inlets 111, 131 and the adjusting opening 122. Then, the air current is discharged from the air outlet 121. Thereby, the fan module 10 can drive the air current from inside the electronic device to an external atmosphere.

In the conventional techniques, the thinner a thickness between the upper case and the lower case of the electronic device, the more possibility for the upper case and the lower case of the electronic device to block the air current passages of the air inlet 111 of the first case unit 110 and the air inlet 131 of the second case unit 130, and the heat dissipation efficiency of the fan module 10 is therefore reduced. Therefore, in order to solve the problem of heat dissipation efficiency of the fan module 10, the fan module 10 according to the disclosure is disposed inside the case of the electronic device. During assembling, based on a distance between the upper case (not shown in the drawings) and the lower case (not shown in the drawings) of the electronic device, the upper case can be pressed against the adjusting element 400 in order to make the adjusting element 400 to move toward a direction of inserting into the socket 123. Thereby, the gap between the free end 320 of the stopping plate 300 and the sidewall 120 is increased in order to increase an amount of air current entering into the case body 100 from the adjusting opening 122. Therefore, when a thickness between the upper case and the lower case of the electronic device is thin, the gap between the free end 320 and the sidewall 120 can be enlarged in order to increase the inlet air amount and thereby enhancing the heat dissipation efficiency of the fan module 10.

According to the embodiments disclosed by the disclosure, the first position, the second position and the third position of the adjusting element 400 are used for describing the positions of the adjusting element 400 relatively to the socket 123, and for describing the operation of how the adjusting element 400 pushes against the stopping plate 300. Nevertheless, the positions mentioned are not used for defining the first position, the second position and the third position specifically.

According to the fan module disclosed in the above embodiments of the disclosure; the adjusting opening is disposed on the sidewall of the fan module; the adjusting element and the socket are disposed adjacent to the adjusting opening; the fixed end of the stopping plate is affixed to the sidewall and adjacent to the first end; and the free end of the stopping plate is disposed adjacent to adjusting opening. By embedding the adjusting element into a socket, the stopping plate is pressed against by the adjusting element and moves.

Thereby, the gap is enlarged between one of the ends (the free end) of the stopping plate and the sidewall for adjusting an amount of inlet air of the adjusting opening. Thus, in comparing with the conventional technique, the fan module disclosed in the above embodiment of the disclosure can enlarge the gap between one of the ends (the free end) of the stopping plate and the sidewall based on the extent of the adjusting element embedding into the socket. Thereby, the amount of inlet air of the adjusting opening can be increased and the heat dissipation efficiency of the fan module can be enhanced. Furthermore, an amount of inlet air to the fan module of the disclosure can be adjusted for fitting electronic devices with different thicknesses of the casing. Therefore, the fan module of the disclosure can be used in various electronic devices so the designing and manufacturing of different models of fan modules are not required. Thereby, the fan module of the disclosure can solve the problem of conventional fan modules not being able to fit various models of electronic devices and can reduce the manufacturing cost.

Note that the specifications relating to the above embodiments should be construed as exemplary rather than as limitative of the disclosure, with many variations and modifications being readily attainable by a person skilled in the art without departing from the spirit or scope thereof as defined by the appended claims and their legal equivalents.

What is claimed is:

1. A fan module for being disposed inside a case of an electronic device, the fan module comprising:

a case body comprising a first case unit, a sidewall and a second case unit, the sidewall being connected between the first case unit and the second case unit to form an accommodating space together, at least one of the first case unit or the second case unit having an air inlet, and the sidewall having an air outlet and an adjusting opening;

a blade assembly disposed inside the accommodating space;

a stopping plate disposed on the sidewall and being used for opening or closing the adjusting opening;

an adjusting element movably disposed on a side of the stopping plate and being used for pressing against the stopping plate, the adjusting element being used for moving between a first position and a second position; and a socket disposed on the sidewall or the case of the electronic device, the socket extending from the first case unit toward the second case unit, the adjusting element being movably inserted into the socket, the adjusting element being used for moving between the first position and the second position inside the socket, wherein the adjusting element is a tapered object, and an outer diameter of the adjusting element is decreased toward a direction of inserting into the socket; and wherein when the adjusting element moves from the first position toward the second position, the adjusting element pushes against the stopping plate and makes an end of the stopping plate to be offset toward the blade assembly, and produces a gap between the stopping plate and the sidewall.

2. The fan module as claimed in claim 1, wherein when the adjusting element is at the first position, the adjusting element is not yet inserted into the socket, when the adjusting element moves from the first position toward the second position, the adjusting element is inserted into the socket gradually.

3. The fan module as claimed in claim 1, wherein the socket has an opening, the opening faces toward the blade assembly, when the adjusting element is disposed inside the socket, a part of the adjusting element is protruded outside the opening and pressed against the stopping plate.

4. The fan module as claimed in claim 1, wherein the adjusting opening has a first end and a second end disposed oppositely to each other, the stopping plate has a fixed end and a free end disposed oppositely to each other, the fixed end is affixed to the sidewall and is adjacent to the first end, and the free end extends to the second end.

5. The fan module as claimed in claim 4, wherein when the adjusting element moves from the first position toward the second position, the adjusting element pushes against the stopping plate and makes the free end of the stopping plate to be offset toward the blade assembly.

6. The fan module as claimed in claim 1, wherein when the adjusting element is at the first position, the stopping plate covers the adjusting opening.

7. The fan module as claimed in claim 1, wherein the stopping plate is disposed between the adjusting opening and the blade assembly, and the blade assembly is a centrifugal blade.

8. The fan module as claimed in claim 1, wherein the adjusting element has an inclined pressing side for pressing against an edge of the stopping plate.

* * * * *